United States Patent [19]

Jarlan

[11] Patent Number: 4,764,052

[45] Date of Patent: Aug. 16, 1988

[54] STABILITY OPTIMIZED PERFORATED BREAKWATERS

[75] Inventor: Gerard E. Jarlan, Versailles, France

[73] Assignee: Canadian Patents and Developments Limited/Societe Canadienne des Brevets et d'Exploitation Limitee, Ottawa, Canada

[21] Appl. No.: 47,793

[22] Filed: May 8, 1987

[30] Foreign Application Priority Data

May 9, 1986 [CA] Canada ..... 508830

[51] Int. Cl.[4] ..... E02B 3/06; E02B 3/12

[52] U.S. Cl. ..... 405/31; 405/21; 405/30

[58] Field of Search ..... 405/30, 31–34, 405/15, 16, 284, 285, 258, 286, 287

[56] References Cited

U.S. PATENT DOCUMENTS

| | | | |
|---|---|---|---|
| 3,118,282 | 1/1964 | Jarlan | 405/31 |
| 4,279,536 | 7/1981 | Jarlan | 405/31 |
| 4,483,640 | 11/1984 | Berger et al. | 405/30 X |

FOREIGN PATENT DOCUMENTS

| | | | |
|---|---|---|---|
| 407575 | 4/1910 | France | 405/30 |
| 1095527 | 12/1954 | France | 405/31 |
| 0000508 | 1/1983 | Japan | 405/31 |

*Primary Examiner*—Dennis L. Taylor

*Attorney, Agent, or Firm*—Foley & Lardner, Schwartz, Jeffery, Schwaab, Mack, Blumenthal & Evans

[57] ABSTRACT

A breakwater comprised of an array of aligned perforated-wall caissons having a slab bottom standing on a pervious rubble base and anchored by its own weight incorporates exceptionally heavy ballasting to ensure stability under attack by large waves, i.e. to that the ratio of maximum horizontal trust force to downward vertical force is below about 0.46.

The immersed wall height is much reduced so that the slab bottom lies below mean sea level about 1.3 to 1.7 times the height of the greatest wave predicted, lessening costs of construction and siting. Efficient energy dissipation function is preserved by placement of augmenting mass below the height of the wave trough and by providing flow passages for jets directed by front wall ducts, avoiding increase of reflection coefficient. The mass may be a pervious rubble store, or a lower-grade concrete case about horizontal pipe ducts extending into or wholly through the chamber, or may be metal slabs supported on racks, or may be apertured fairing bodies carried on the front wall. Double-sided breakwaters on coasts where wave incidence occurs only at high tides incorporate a large proportion of ballast mass; when oriented as groins to protect a river mouth, the porting of an intermediate wall allows sands to migrate freely through without accretion.

The rubble base comprises a core of gravel capped by larger rubble.

27 Claims, 9 Drawing Sheets

STABILITY OPTIMIZED PERFORATED BREAKWATERS

FIELD OF THE INVENTION

This invention is in the art of seabed-supported marine structures which are anchored by gravity forces, and is directed more particularly to perforated-wall type breakwaters formed as aligned caissons which are exposed to long-period large-amplitude waves.

BACKGROUND OF THE INVENTION

Heretofore, practical monolithic caisson-form breakwaters have been constructed at may locations around the world, comprised of horizontally-extended arrays of box-form concrete bodies closed at their bottom by horizontal slabs, each having a seaward-facing vertical front wall that is extensively perforated and spaced from a parallel unapertured rear wall, and defining therewith an upwardly-open container or chamber. Unlike historic bulwarks, moles, seawalls and similar massive masonry piles intended to oppose and reflect most of the incident wave energy, the undermining and catastrophic disintegration which such prior forms experience is wholly avoided by the monolithic caisson, because only a minor part of the energy of incident waves is reflected. Dynamic pressures at seabed adjacent the perforated wall are only slightly greater than if no obstacle whatsoever were encountered by arriving waves; consequently, such scouring of bottom materials by currents as may occur in severest storms is minor, and may easily be rendered harmless by covering the seabed at the toe by a shallow rubble layer.

A full description of such monolithic prior art breakwaters will be found in U.S. Pat. No. 3,118,282 issued Jan. 21, 1964 to Gerard E. Jarlan, and hence need not be repeated here in detail. For convenience and to assist in understanding the present invention, the following brief review is included.

The front wall of a modern caisson-form breakwater presents a large multiplicity of uniformly-distributed openings to the sea, these being formed by the ends of tubular transverse passages which are preferably of cylindric form and of length roughly equal to their diameter, each dimension being of the order of a meter. Wave energy is converted from periodic rising and falling of the sea surface and attendant orbital motion of water particles, into massive horizontal flow through the wall as guided horizontal jets which have aggregate kinetic energy equal to the greater part of the average energy of the wave. The multiplicity of directed jets alternately flowing into the chamber as the sea rises, followed by an equivalent mass outflow as the sea recedes, function as an efficient hydraulic phenomenon requiring only a small head difference to set up the flow, and hence to convert wave energy with only a small reflected component. Other phenomena attending the filling and emptying of the chamber, such as vigorous aeration by spill flow through air/water interfaces, and massive injection into the wave trough, contribute to wave dampling by setting up a zone near the front wall in which turbulence is severe, thereby disordering incident following waves. It is estimated that the reflected energy, expressed as a coefficient of incident wave amplitude, is about 0.14 at the upper part of the front wall, increasing generally linearly downwardly to about 0.21 at the slab bottom.

Important advantages are to be gained in the construction of the box-forms, which proceeds by upwardly advancing slip-forming of the walls above a floating bottom slab, using a shuttering system in a sheltered body of water connected with the open sea by a deep channel which is closed by sea gates, when the caisson height is restricted according to the invention. The construction site does not have to be of an inordinate depth as would be necessary if the minimum floating height is, say, 15 meters. Unlike the procedure attending the casting of walls higher than about 25 meters, where the partially-constructed body must be moved into the sea for the greater part of its building, considerable cost is saved when the structure may be virtually finished in a relatively shallow inlet or embayment. Thereafter, the towing, positioning, and accurate settling of the caissons in alignment is much less difficult than when the structure has a larger vertical extent.

GENERAL OBJECT OF THE INVENTION

It has long been understood that the cost of construction of caissons is a large multiple of the materials costs. As the concrete must meet stringent specifications and the reinforcing steel used must be placed so that the structure will endure for scores of years, the overall cost can only be lowered by limiting optimum dissipation. It is also now well understood that durable submerged rubble bases may be built upon a seabed at a cost per unit height well below the construction cost of the same unit height of caisson. An object of the present invention is to realise the potential cost reduction of employing deepened rubble bases as supports for such truncated caissons, as for example where the overall height is only about 26 meters and the breakwater will stand in a sea of 30 meters depth with about 19 meters of wall below mean sea level, and to provide a form of breakwater which will allow economical emplacement in sites where a breakwater installation could not heretofore be contemplated.

GENERAL STATEMENT OF THE INVENTION

The invention proposes to increase very greatly the unit load exerted by the slab bottom of the caisson on a rubble base, in order to prevent sliding or shifting under very large horizontal wave forces and uplift pressures, where the coefficient of friction of a rubble base against the concrete structure and the net downward force, i.e. the net weight of the structure, would not ensure stability. A further problem in providing adequate anchorage by gravity force, namely the provision of sufficiently increased structure weight of a concrete monolith whose distinguishing characteristic is thinness of its walls and slab bottom, is in disposing such otherwise unnecessary mass without impairing its primary function—which is efficient absorption and dissipation of wave energy—and without incurring significantly increased reflection.

The magnitude of the difficulty may be appreciated from the fact that the quantity of added ballast necessary may be a large fraction of the dry weight of the caisson. The difficulty is compounded by the relatively high value of average dynamic pressure exerted over the entire vertical extent of the perforated seaward-facing caisson wall, as for example when it is impinged by a wave of 14-second period having a wave height about 15 meters and the immersed wall portion below mean sea level is much less than twice the wave height.

By the provision of the novel gravity-force anchorage arrangements of this invention, the structures are made fully capable of withstanding waves without hazard of undermining or movement.

The invention extends also to caissons sited, for example, in a sea subject to tidal and barometrically induced depth changes allowing long-period, large waves to impinge a breakwater standing at times when the sea is high in a mean depth about 13–15 meters. In such locations the entire extent of the front wall of the monolith measuring about 20 meters, experiences very large average dynamic pressures, requiring large additional anchoring mass. The high bottom pressures attending large wave heights make it imperative that any added mass should not significantly increase the reflection coefficient of the front wall.

The invention provides a configuration of a perforated-wall caisson intended to form part of a breakwater and comprising a pair of spaced upright walls connected with a slab bottom and transverse upright bracing walls, all formed as a monolith, wherein the caisson stands on a rubble base placed on seabed and the immersed vertical extent of the walls as measured below mean sea level is less than twice the maximum wave height of the design wave to be dissipated, and is from about 1.3 to about 1.7 times the wave height, and wherein the structure is ballasted by placement of immersed mass sufficient so that the structure is frictionally stable on said rubble base and said structure has an immersed overall weight at least from about 1.7 to about 2.3 times the peak horizontal force sustained by the caisson when subjected to the maximum thrust force of said wave.

The invention also provides for placement of immersed ballasting mass upon the slab bottom between the caisson walls, or upon outward ledge extensions of the slab, or in both locations, but preferably the highest part of such ballast is not above the lowest height of the sea outside the front wall.

It is also within the scope of the invention that the added ballast mass is sufficiently pervious to inflow of water jets through the lower portion of the front wall so that reflection is not greater than about 0.3, and is preferably lower, and to this end tubular passages coaxial with the passages through the front wall extend through such mass allowing unobstructed horizontal flow.

It is contemplated within the invention that the added ballast mass comprises rock material of fragment weights 300 to 600 kg randomly piled on the slab bottom.

It is to be understood that the pervious ballast mass guides flow between the sea at the front wall and the sea behind the rear wall without communication with the chamber, in one version.

In yet another aspect the ballasting mass is simply concrete case about horizontal smooth-bored pipes fixed at right angles in apertures of the lower part of the front wall and serving as jet-guiding ducts, the pipes extending at least a major length portion of the chamber span and allowing vertical flow betwen the chamber and the inner ends of the pipes.

In a related aspect, the pipes terminate within 1 to 3 m distance from the back wall, the highest pipes having lesser lengths than those along the bottom of the chamber.

From still another aspect, the invention is to be understood as comprising pipes extending through the front wall in which their one ends are integrally cast with that wall and extending also through the back wall in which their other ends are integrally cast, and the cylindric surfaces of the pipes are ported by a multiplicity of regularly-spaced holes allowing flow into and out from the chamber with respect to the interior of the pipes.

It is contemplated according to the invention that a ballasting as referred to immediately hereinabove is augmented by emplacement of rock fragments of a range of sizes not smaller than the largest transverse dimension of the holes of said ported pipes, said fragments not exceeding the least dimension between the pipes.

The invention is also to be understood to provide a widened slab bottom having integral ledges extending outwardly from the planes of the front and the rear walls by several meters, for loading by pervious rubble. It is also within the purview of the invention to provide tubular passages in the front wall that are cylindrical with horizontal axes, and to provide associated ballast bodies having one planar face adapted to be affixed on the outer surface of the front wall and having a flow-guiding apertured registered on said axes, the diameter of the aperture increasing outwardly of said planar face from the passage diameter to a maximum diameter about 1.4 times the passage diameter.

It is further contemplated that the foregoing expression of the invention be realised as a cast metal such as steel.

Yet other aspects of the invention are to be understood in the provision of ballast mass in the form of metal slab bodies supported on the caisson bottom by racks, and extending horizontally at least a major length portion of the chamber, the slabs being aligned generally tangentially of phantom cylinders coaxial with the ducts of the front wall, and allowing substantially unimpeded vertical flow between the slab bodies.

The invention offers great cost advantage in building, that is comparable with the large net savings possible on construction of lower-height caissons, after deducting the lesser costs of the deepened rubble base and added ballast.

The invention will now be described in greater detail with reference to the accompanying drawings, of which:

Figure 1:
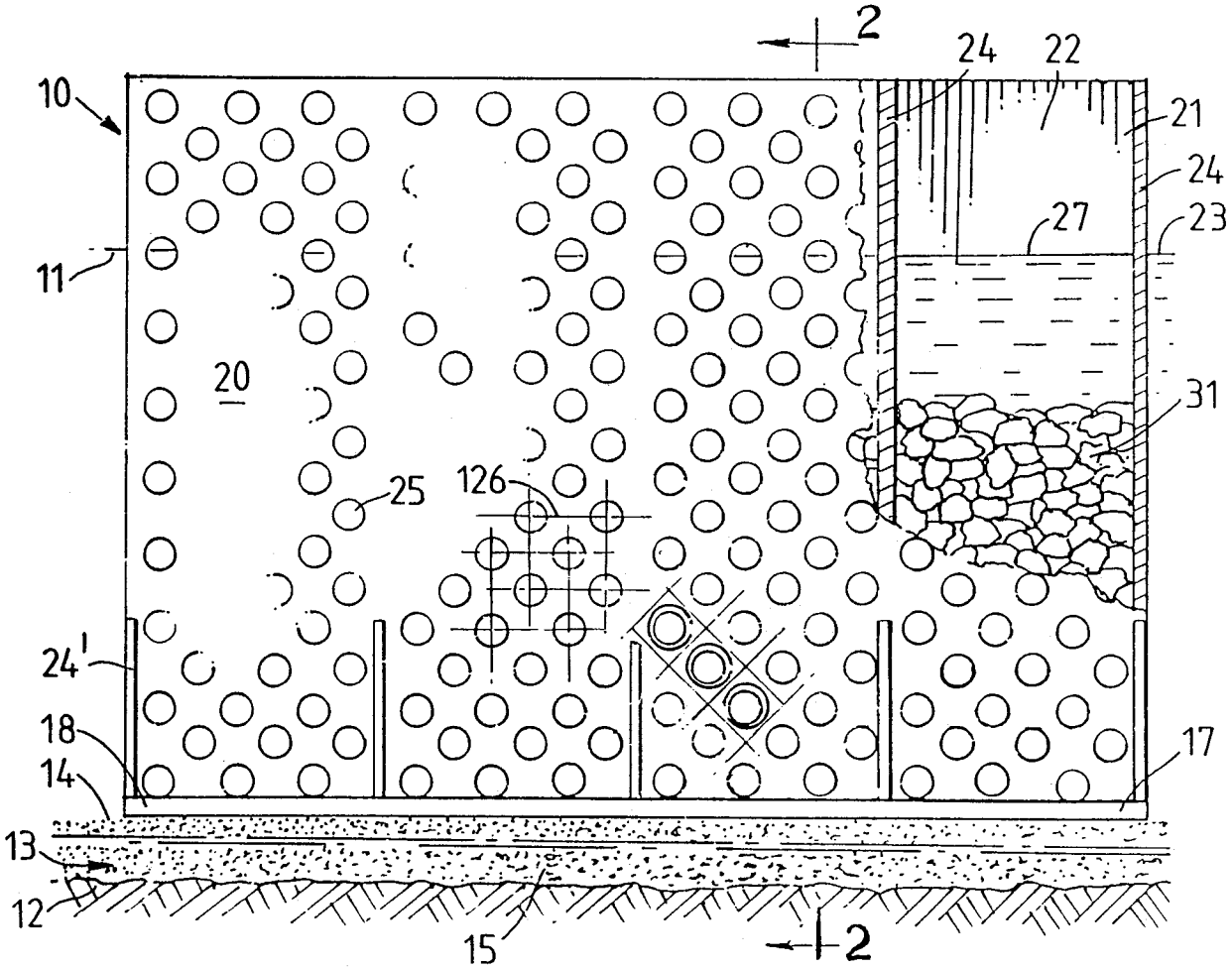
FIG. 1 is a front elevation view of a caisson and base.
Figure 2:
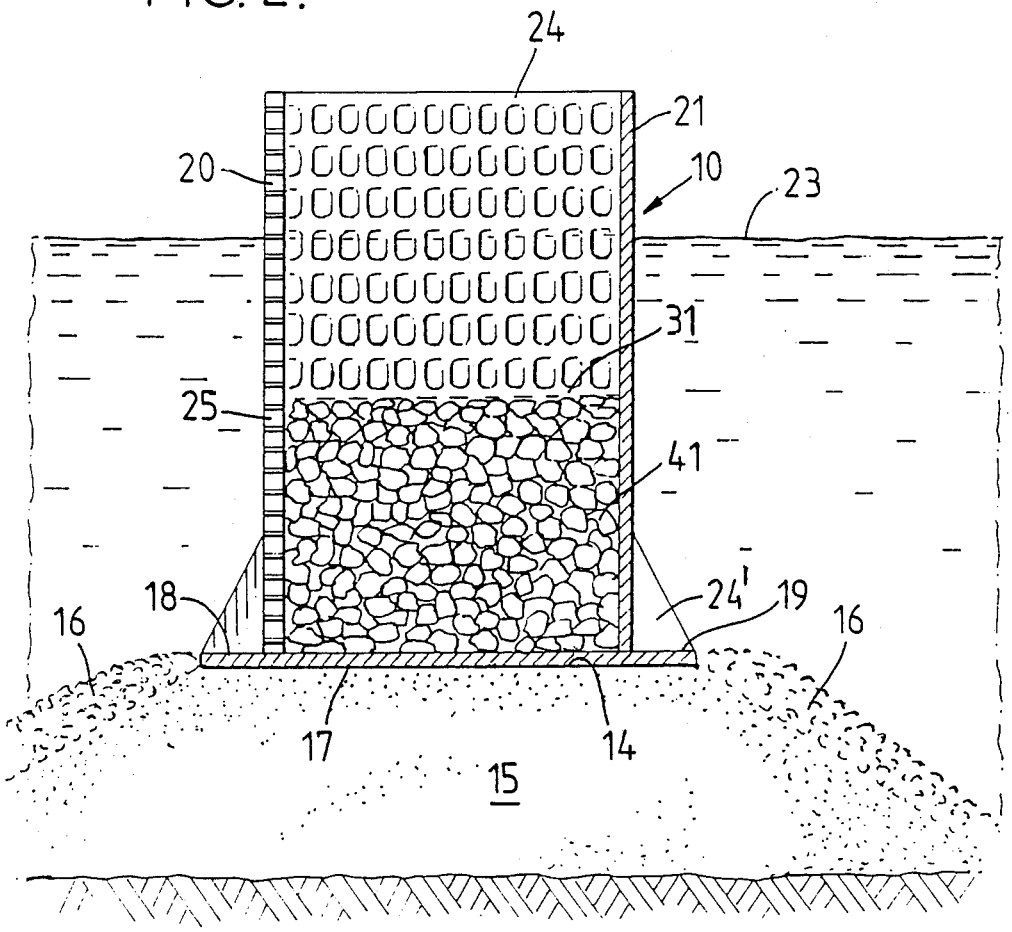
FIG. 2 is a view on vertical sectioning plane 2—2, FIG. 1.

With reference to the drawing, an illustrative caisson structure 10 as viewed in elevation, FIG. 1, and on a vertical sectioning plane 2—2 in FIG. 2, stands in a sea 11 on seabed 12. A rubble base 13 has a levelled upper surface 14 of its core 15, comprised of smaller rubble fragments, with flanking rubble banks 16 lying along the sides of the core body. The flanking rubble comprises larger rock sizes, e.g. 0.3 meters and larger, while the core gravel may be of 30–40 mm sizes. The base material has sufficient porosity so that it is wholly pervious to seawater and allows restricted flow through it. The height of the base will depend on sea depth, but surface 14 should not be closer to the datum plane—Mean Sea Level—than about 1.3 to 1.7 times the maximum wave height. For example, in a depth of 30 meters, surface 14 may be located at about 10 meters above seabed.

Caisson 10 has a slab bottom 17 resting upon the core body, and has ledge portions 18, 19 extending partly over the banks 16, for example about 3 meters. Integrally formed with the slab bottom are an upright front wall 20 facing the open sea and a back wall 21 spaced from and parallel with the front wall to define an upwardly-open container or chamber 22. The walls extend sufficiently above the level of the sea denoted by surface 23 behind the back wall so that the crest height of an incident wave including a reflected amplitude component does not significantly exceed the wall height; for example where the period of the expected largest-amplitude wave would be 14 seconds and its height from crest to trough, i.e. $2h_o$ may be predicted not to exceed 11 meters, the wall margins may rise about 7 meters above MSL.

A series of transverse upright brace walls 24 are integrally formed and connected with the slab bottom and the front and back walls, and extend to the same height with them, allowing a roadway or platform (not shown) to be carried above the sea, if desired. In a caisson of length about 26 meters the number of brace walls may be five, of which two are end walls. Except as will be described at a later point, the brace walls are perforated, for example to leave 55% of the structure for transferring horizontaly and vertical loads. External buttresses 24' connect ledges 18 and 19 with the front and back walls and extend in the planes of walls 24.

The front wall is extensively perforated by a large multiplicity of transverse passages designated 25, leaving about 65% of the elevational area without openings; the arrangement of passages may be in any pattern affording a regular distribution of openings, and advantageously may comprise a first grid pattern in which passage axes 26 are centered on the corners of a square, i.e. with uniform spacings along horizontal rows and vertical columns of the pattern; a second identical grid pattern is superimposed on the first grid pattern to center the corners of its square on the centers of squares of the first grid pattern.

Transverse passages 25 preferably are short cylindric ducts with smooth internal surfaces, preferably but not necessarily cast of very durable concrete presenting minimal drag to flow in either direction. For high efficiency of conversion of hydraulic head to guided jet flow the length is desirably about 0.9 meters and the passage diameter about 0.93 meters. Except as will be referred to at a later point, the ends of the ducts are enlarged with inner surfaces faired smoothly for example the opening diameter in the plane of the front wall surface is about 1.3 meters, and the duct diameter decreases smoothly within about 15 cm axial distance to 0.93 meter.

The function of the front wall acting together with the chamber volume and the unperforated back wall, is to set up a massive horizontal flow of water through a large multiplicity of wetter passages as guided jets under the head of a rising sea, so that the greater part of the energy of an incident wave is converted to kinetic energy of such flow. As the volumetric rate can be enormous, it is necessary that the chamber span be matched to accept the inflow. In general when the breadth dimension "l" is appropriate for the largest amplitude long-period wave, upper surface 27 of the injected volume will, at any instant during the cresting phase be somewhat below the height of the sea at the front wall. The rates of inflow into the chamber and rise of water level therein involve wave phenomena related in part to the periodicity of sea state outside the caisson and to the temprarily increased height inside the front wall. The profile of surface 27 is chaotic during the filling of the chamber, but at the time when the seawave crest is passing the plane of the front wall the profile will slope downwardly to the back wall; a short time later as the seawave starts to recede, because the back wall is totally reflecting, the profile will have a slope steeply rising toward the back wall, after which the level begins to fall, but delayed with respect to the height of the sea.

For optimum cooperative action with the ducted front wall, the chamber span should be a function of wavelength $\lambda_d$ in the sea depth where the caisson is sited, for a given design wave period. Accordingly, for largest waves of periods 7 to 10 seconds the span "l" which would be appropriate lies between $\lambda_d/8$ and $\lambda_d 10$; for periods from 10 to 12 seconds the range of span would be between $\lambda_d/10$ and $\lambda_d/12$; and for periods 12 to 15 seconds the range would be between $\lambda_d/12$ and $\lambda_d/15$.

For any wave periods and sea depths, $\lambda_d$ may be found by iterative solution of the function:

$$\lambda_d = \lambda_o \operatorname{Tanh} \frac{2\pi d}{\lambda_d}$$

where $\lambda_o$ is the wave length: $g^{T2}2\pi$ in very deep water, "g" is the gravitational acceleration constant 9.81 m/s$^2$, and "d" is the sea depth in meters.

From the foregoing for a design wave of period 14 seconds for which $\lambda_d$ in a sea depth 30 meters may be found as 215.4 m, the span "l" may be chosen from about 15.5 to 17 m. Similarly if "T" is 10 seconds and "d" is 14 meters, the crest-to-crest distance of a model wave is about 106.4 m.

BALLASTING REQUIREMENTS

In order to evaluate the magnitude of peak thrust forces imposed by an incident large wave and specifically the peak composite horizontal force sustained by both the front and back walls of the caisson it is necessary to find the amplitude of the wave near the front wall which combines the unaltered energy propagating toward the caisson and the fraction reflected back by the structure. The amplitude may be expressed as:

$$h' = h_o(1+\alpha)$$

where h' is effective amplitude in meters, $h_o$ is the amplitude with zero reflection, and $\alpha$ is a reflection coefficient ranging from about 0.14 to about 0.18 for wall surfaces within a few meters of the datum plane, and ranging upward to about 0.23 at the slab bottom. The coefficient for a rubble base of porosity at least 35% may be taken as about 0.35.

The significance of the reflection coefficient is profound, as when a structure is to be placed in a shallow sea to withstand large waves where it would be in hazard of undermining by vigorous bottom currents if the coefficient is not small. Solutions for the following functions are used to obtain at depths of interest, the values of velocity "V" and of pressure "P"

$$V = \frac{2\pi h_o}{T}(1-\alpha)\frac{\text{Cosh}\,\frac{2\pi z}{\lambda_d}}{\text{Sinh}\,\frac{2\pi d}{\lambda_d}}\,e^{-i\sigma t}\ m/s \quad (1)$$

$$P = \rho \cdot g \cdot h_o(1+\alpha)\frac{\text{Cosh}\,\frac{2\pi z}{\lambda_d}}{\text{Sinh}\,\frac{2d}{d}}\ \text{Pascals} \quad (2)$$

where:

z is the distance above seabed to the point investigated;

$\sigma$ is the wave phase at instant "t" and represents $2\pi/T$;

$\rho$ is 1026 kg per cubic meter of seawater.

The term ($e^{-i\sigma t}$) expresses phase and propagation direction of the wave with time, the convention here being that the crest arrives at the front wall plane at instant t=0.

Figure 3:
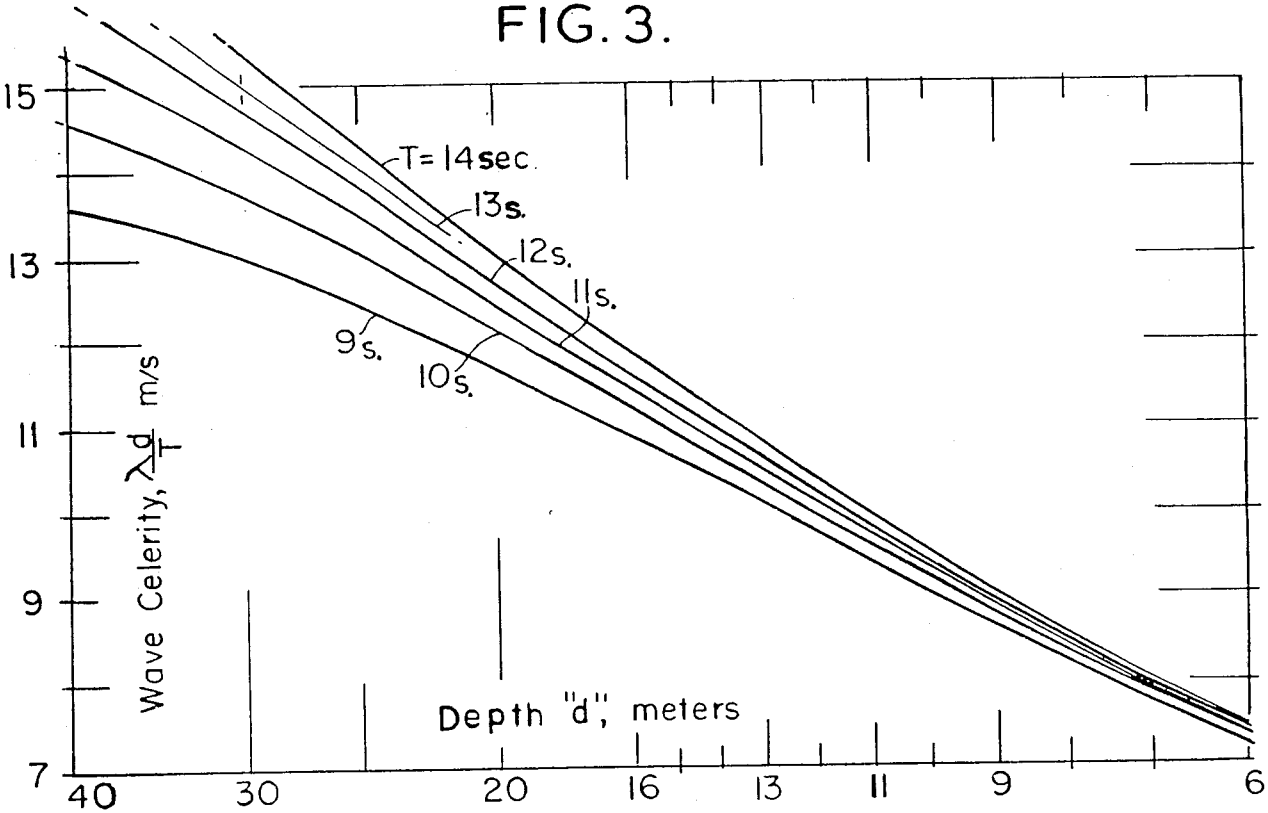
FIG. 3 is a graph relating wave celerity for a range of wave periods with depth of the mean sea.

Equations (1) and (2) should be used in conjunction with FIG. 3 which graphically illustrates the change of wave celerity with depth for a range of periods of waves most likely to propagate into shallow sea depths, and will aid in inferring how amplitude $h_o$ increases with reduction of crest-to-crest distance for a given rate of energy propagation in deeper water, until the waveform becomes too steep and the wave collapses.

Figure 5:
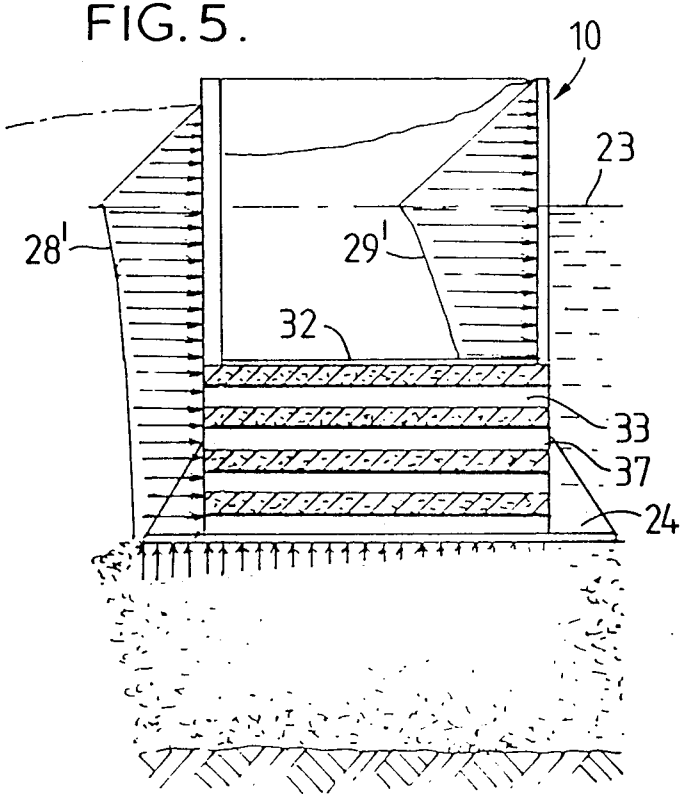
FIG. 5 is a view similar to FIG. 4 shortly after the phase depicted in FIG. 4.
Figure 4:
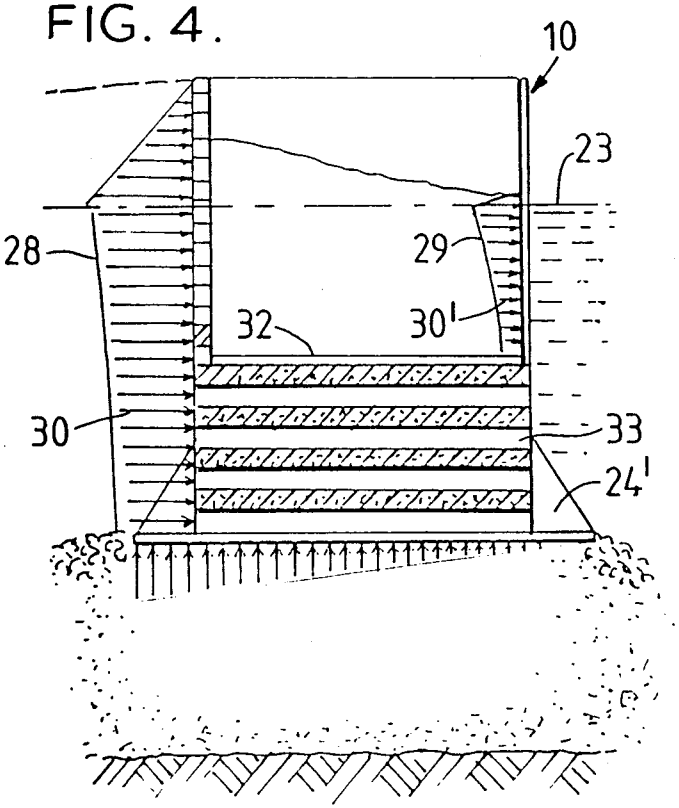
FIG. 4 is an elevation view similar to FIG. 2 but with monolithic ballast, showing wave forces at the crest of a wave.

Referring next to FIGS. 4 and 5, there are shown successive phases of wave incidence when the height of the sea 11' at the front wall is maximum in FIG. 4, and wherein the water level in chamber 22 has increased in FIG. 5 a short time later from 27' to its maximum elevation 27'' and the sea height has decreased to 11''. Accompanying each drawing, outlines 28 and 29, and 28' and 29' are envelopes representing the variation with height above slab bottom of dynamic pressure vectors such as 30 and 30', which act respectively over the outer surface of front wall 20 and over the chamber side of the back wall 21. The vector magnitudes may be computed from equations (1) and (2) appearing hereinabove.

BALLASTING ARRANGEMENTS

Practical embodiments of the invention that place pervious ballast mass 31 in the lower portion of chamber 22 are shown in FIGS. 2, 4 and 5. The mass extends upwardly from slab bottom 17, to a level or nearly level upper surface 32 preferably slightly lower than the lowest height of the sea when the trough of the design wave is at the front wall. Ballast 31 of FIG. 2 comprises larger quarry stones, e.g. having roughly uniform length, width and thickness dimensions and preferably of mass 2 to 4 tonnes or more. The stones are placed into the standing caisson after it has been sited, as by lowering the pieces by slings. The randomly-piled pervious mass should have inter-fragment volume at least about 25%, up to about 40% of the bulk volume, so that it offers low impedance to jets flowing from passages 25. Such ballasting represents an economical solution where shipping and handling costs are low.

Where a supply of larger-size quarry stones of properties suitable for its use as ballast may not be available locally, the embodiments of FIGS. 4 and 5 would be preferred. In these, mass 31 is a concrete monolith provided with horizontal passages 33 extending through the front wall 20, also through the ballast mass 31, and through the back wall 21, there being no communication between the sea and the chamber through any passages 33. However, free flow in all of the passages is possible whenever a hydraulic head exists, depending on sea height and the datum plane surface 23. The axes 26' of passages 33 coincide with the appropriate grid pattern of front wall openings as previously discussed.

The grid pattern may be understood from the front elevation view, FIG. 1 wherein lines 126 crossing at right angles include rows of horizontally spaced axes 26 and columns of vertically-spaced axes of one grid pattern, while lines 126' define squares of the associated grid pattern. Where the desired ratio of passage cross-sectional area to wall elevational area is 35%, the squares measure 1.97 meters when the passage diameter is 0.93 meter.

The diameters of passages 33 are constant along their lengths, and may be identical with the remainder of the front wall passages, i.e. those above the monolith, or they may be made somewhat larger to decrease drag slightly, for example up to about 1.2 m.

The outlines 29 and 29' terminate at surface 32, where the magnitude of the dynamic pressures acting on the back wall is significantly smaller than in the datum plane. The outlines 28, 28' depict that horizontal pressure is at maximum at the moment of incidence of the crest at the front wall plane, and hence the thrust force is also maximum, and show that at the time when the motion of water in chamber 22 has elevated its height to a maximum adjacent the back wall, the pressure, and hence thrust force, are reduced.

Figure 6:
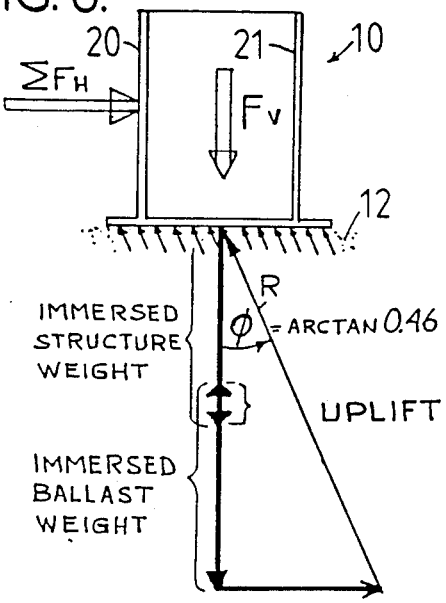
FIG. 6 is a vector diagram showing stability criteria and illustrating evaluation of required ballast mass.

Referring now also to FIG. 6, a force diagram is illustrated wherein the integral value of pressure vectors 30, 30' over the areas of walls 20, 21 which sustain thrust forces are combined to yield an aggregate force designated by vector $F_H$. The summation taken refers to conditions of FIG. 5 since it has the highest magnitude, but in each case a peak instantaneous value must be found by examining a range of wave phases.

Caisson 10, as represented by slab bottom 17 exerts an aggregate downward force vector $F_V$, and the rubble core surface 14 opposes the resultant R. Taking the coefficient of friction for concrete on rubble as 0.6, and employing a safety factor for frictional stability of at least 1.3, the possibility of sliding is avoided when:

$$\frac{F_H}{F_V} = \frac{0.6}{1.3} = 0.46.$$

Where it may be found, for example, that the peak value of $F_H$ is about $1.35\times10^6$ Newtons per horizontal meter of length dimension of the caisson, the aggregate of vertical forces must be about $2.93\times10^6$ Newtons. To determine how much ballast mass must be provided, one has to subtract the immersed weight of the structure, the force exerted on surface 32 by the water volume lying above the datum plane, and add the upward force due to hydraulic pressure acting upwardly on the underside of slab bottom 17, including ledges 18 and 19. Depending on the chosen height of rubble base surface 14, the weight of a segment of a caisson formed of reinforced concrete which is virtually wholly immersed at the conditions of FIG. 5 will be relatively a small part of the total of $2.93\times10^6$ Newtons. Therefore a depth of concrete ballast will be needed, for example 8 meters or more, if the mineral aggregate has a density comparable to limestone. It will be clear that use of higher-density aggregates would be advantageous in decreasing the height of mass 31, and to this end the mix may include as much steel fragments as will be economically justified. Since the ballast mass is not subjected to loads affecting the caisson structure, it need not be reinforced, and may be a much cheaper material than is required for the walls and slab bottom.

The ballast mass 31 does not require to be in place when the caisson is towed to its site, but a lesser portion 34 may be put into the caisson and the greater part added after settling of the caisson on rubble base 13. The construction most simply effected involves preforming tubular bodies 35 of length to extend through both caisson walls, of highest-quality concrete as specified for duct lining, and casting the front and back walls around their end portions while holding the bodies 35 horizontal and in the required relative positions. Consequently the procedure is very similar to the standard slip-forming of the walls, using pre-formed short ducts.

Figure 7:
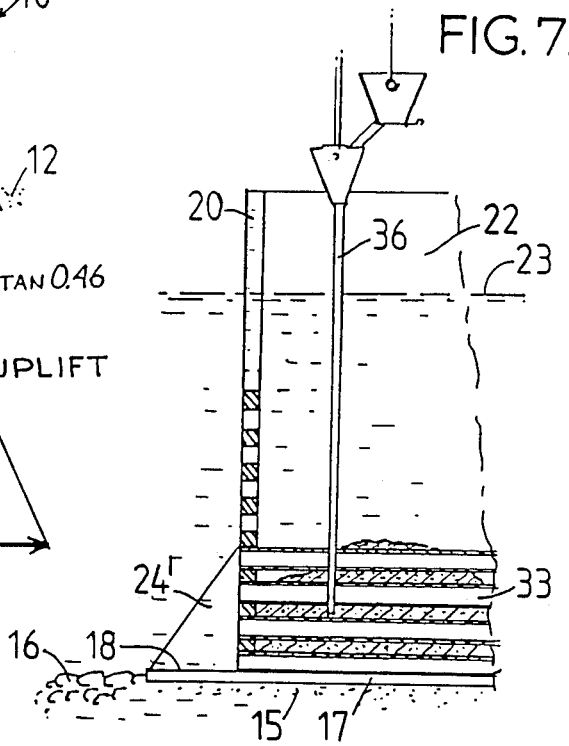
FIG. 7 shows emplacement of concrete about pipes extending through the chamber to form a cast monolith.

As seen in FIG. 7, the emplacement of ballasting mass is by means of a tremie 36 which directs plastic concrete mix between the tubular bodies, displacing sea water, until the desired height has been cast.

Figure 8:
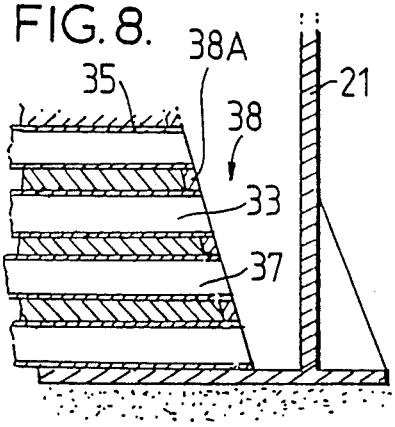
FIG. 8 shows a ballast mass similar to FIG. 7 but not extending entirely to the back wall.

As shown in FIG. 8, the pervious ballast mass 31 is also realized by casting a lower-cost grade of concrete around tubular bodies which extend from anchored ends in the front wall, almost to the back wall, but communicating at their ends 37 with the chamber. Preferably, but not necessarily, the highest tubular bodies are made shorter than the lowest tier, so that a passage 38 opening upwardly extends from the slab bottom to the level of surface 32. The ballast is similarly cast as in FIG. 7 except that suitable formwork 38A must be built to prevent ingress of concrete into the tubular body ends 37 to form the passage 38, and to support the tubular bodies.

Figure 9:
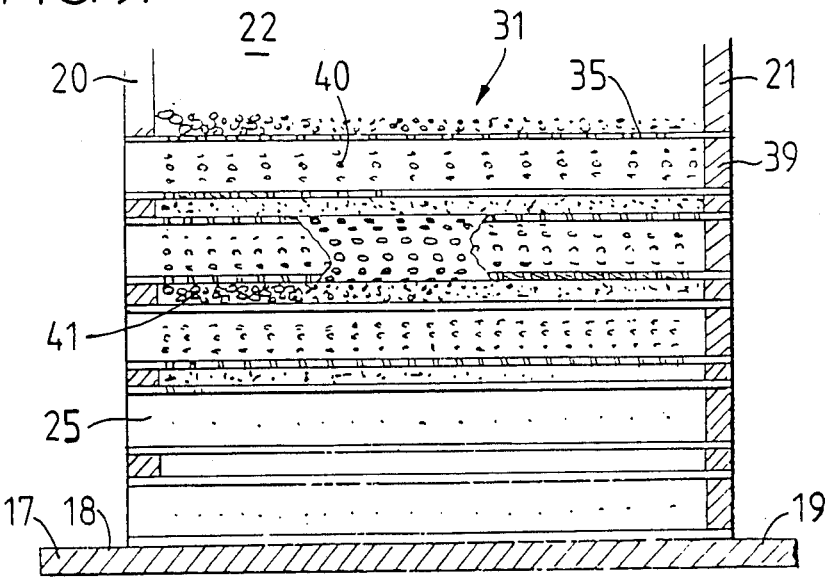
FIG. 9 shows an alternative ballasting arrangement combining ported pipes and a packing of sized rubble around them.

In FIG. 9, cast tubular bodies 35 as shown in FIG. 8 occupy the same relative positions as in FIG. 7, but have their ends sealed by plugs 39 so that no openings exist in the back wall. The ballast mass is however made pervious by forming bodies 35 with their cylindric surfaces extensively perforated by holes 40, so that water can interchange from chamber to sea and vice versa by flowing into or out from the holes. To ensure a sufficient weight of ballast, once the caisson is settled in position, sized rubble fragments 41 are guided by flexible ducts (not shown) similarly to the guiding of plastic concrete mix, to fill the spaces around the tubular bodies with pervious material. The fragment sizes must be correlated with hole diameters and with the closest spacings between outer surfaces of the bodies, so that material is not lost in the bodies, and voids are absent.

While the method of ballasting in the foregoing embodiments is relatively economical in employing either lower-cost concrete or rubble, the tubular bodies represent significant cost in that they must be made to stringent specifications of concrete, and have an aggregate volume which is a substantial fraction of the final monolith volume, or volume of tubular bodies and rubble pack. Where stone may be procured locally in the form of graded fragments from about 0.4 meter to 1.3 meters the caisson 10 is simply made to be a receptacle for the required height of piled fragments. In such embodiment, fragments 41 of only sizes larger than one meter are piled against the inner side of front wall 20, while smaller fragments are used to fill the major part of the space. Such packing scheme represents the lowest impedance to inflowing jets, while affording excellent permeability both horizontally and vertically. The highly pervious pack allows the pile to be extended rather further upward than would a monolith, but in any case the height should not be above the lowest level of the sea adjacent the front wall, i.e. at the trough phase as depicted in FIGS. 1, 2 and 10.

Figure 10:
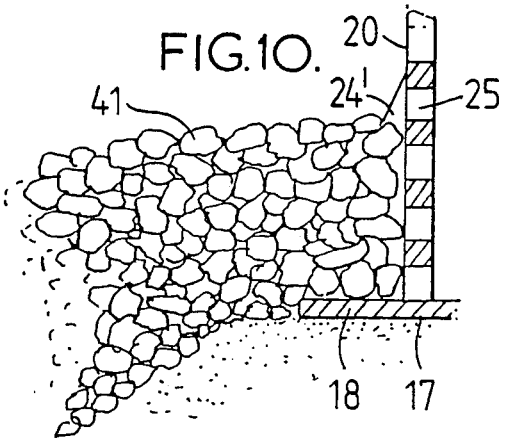
FIG. 10 shows a deposit of larger stone loading ledge extensions of the slab bottom and extending over the base flanks.

As a means for further loading the caisson there may be placed on ledges 18, 19 and extending onto flanking rubble 16, stone fragments 41 of sizes such that the inflow and outflow from passages 25 is not obstructed, as shown in FIG. 10.

Figure 12:
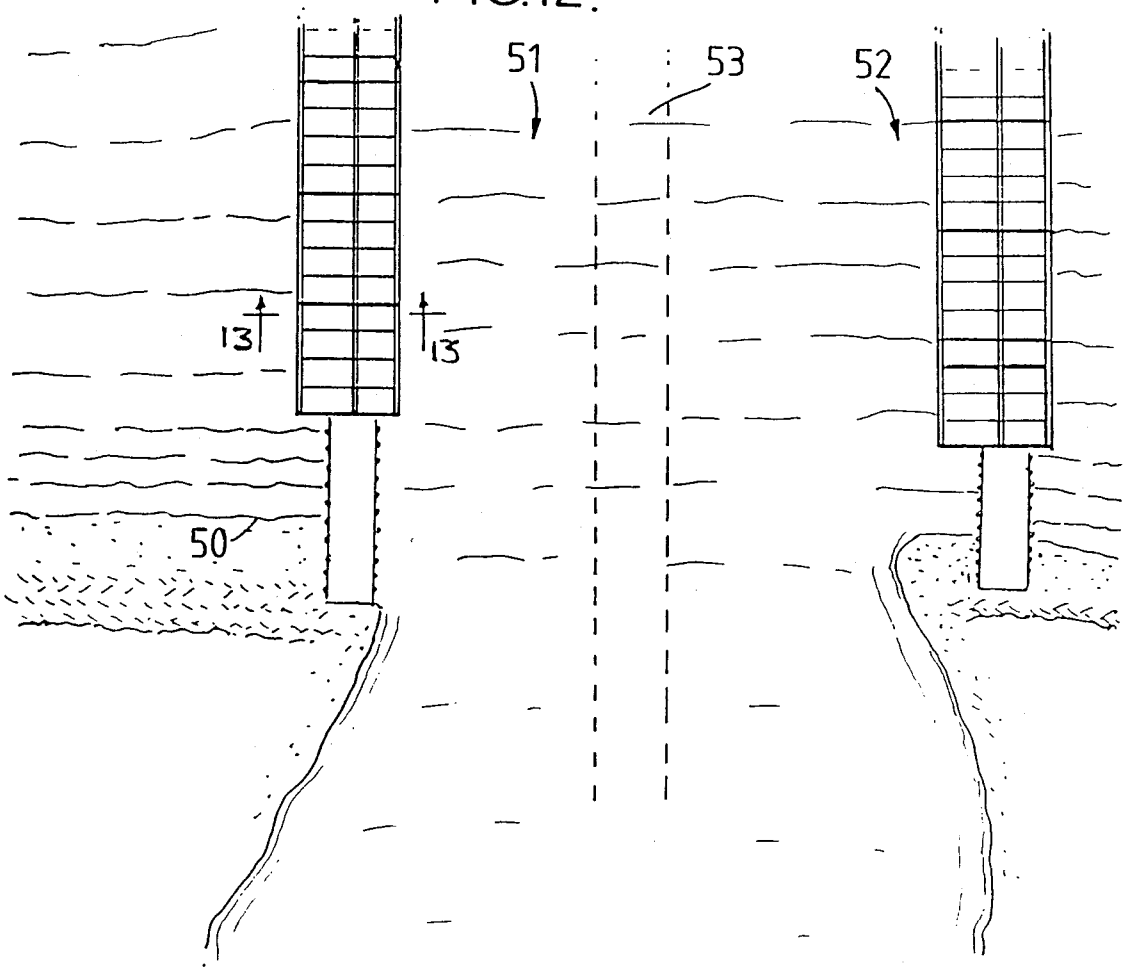
FIG. 12 and FIG. 13 show, in plan and in section 13—13, a double-sided caisson breakwater installed as combined groin/breakwater structure protecting a channel at a river mouth.

The invention extends to caissons sited in shallow water, for example in a coastal region where effects of wind, barometric variation, and tides may leave the slab bottom barely wetted, or even out of the water, and at highest sea level the depth may be only 13 to 15 meters. Since waves of periods from 10 seconds and greater may propagate almost to the shore albeit at incipient collapse, the ballasting of caissons having slab bottoms located on a thin rubble base whose upper surface 14 is disposed about 12 or 13 meters below datum plane (taken as +14 meters), as shown in FIG. 12, is exceptionally difficult. Since bottom pressures, and velocities as well, are relatively large at seabed, the risk of undermining is particularly great when only slightly increased reflection results from use of internal ballasting. Since the structure weight when nearly wholly immersed is even smaller in proportion to the required force $\Sigma F_V$ specified for avoiding sliding, the highest level to which ballast may be added will be close to the −7 meter level, relative to datum plane. Unless a concrete of density higher than 2500 kg/m$^3$ is used, or additional ballasting arrangements are provided, the measures described hereinabove may not ensure stability.

Figure 11:
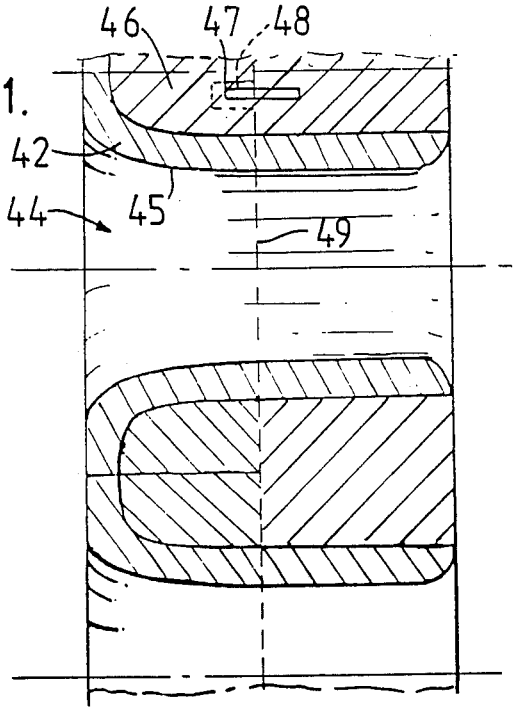
FIG. 11 is a vertical axial section through an apertured ballast body fixed on the exterior of the front wall.

As shown in FIG. 11, additional ballast mass may be provided without significantly increasing the impedance of front wall ducts 25, by fitting cast bodies 42 of square plan form, of side dimensions conforming to the grid pattern of distribution of passages 25, on the outer surface 43 of the front wall 20, wherein these comprise openings 44 coaxial with the duct axes 26. The diameter of the opening is largest in a plane remote from surface 43 and decreases smoothly to define a curved surface 45 as a body of revolution, with diameter in the plane of surface 43 identical with the diameter of passage 25. The axial extent may be a large fraction of one meter, for example 0.4 to about 0.7 m. When bodies 42 are cast in concrete the faired surface 45 must be formed by casting at least a shell portion of highest grade concrete equivalent to that used for passages 25. The remaining volume 46 may be a lower-cost concrete and advantageously may contain steel fragments. The shell may comprise a corrosion-resistant metal, or the entire body may be formed of such metal to gain mass.

The bodies may be fixed in place during the building of the caisson, without impeding flotation significantly, by sealing the openings 44 and gaining displacement volume. A means of fixing the bodies when these are assembled after building uses pins 47 anchored in wall 20 as by concrete cast during building, the pins serving to position and support the bodies by engaging holes in their planar sides 49 and being fixed therein as by grout or other setting material.

Figure 13:
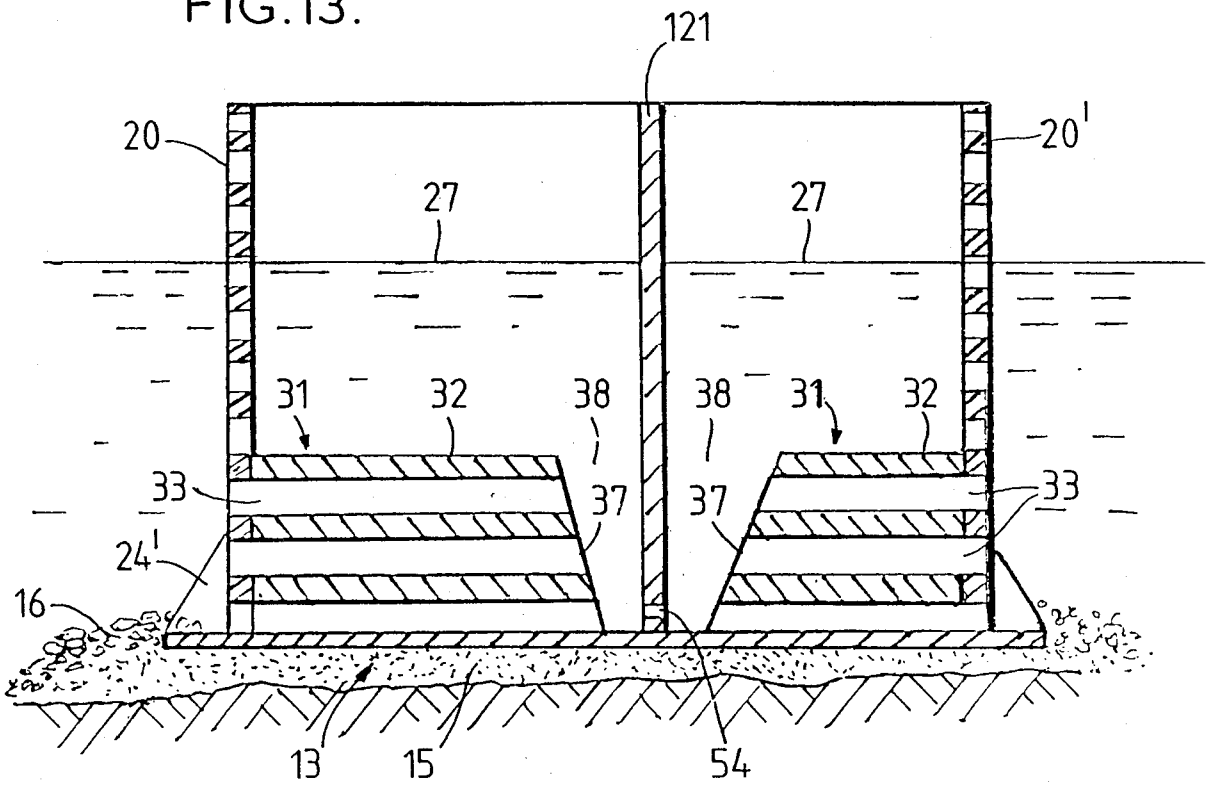

The required additional ballast mass may be reduced by constructing caissons 100 as double-sided units, as shown in FIGS. 12, 13, such form being particularly useful as a combined groin/breakwater when arrayed generally at right angles to a shoreline so that it provides sheltered lee areas 51, 52 depending on the sectors from which waves may be expected. For example at a site where two lines of caissons are placed on opposite sides of a navigable channel 53 in a river mouth or estuary, one side may be likely to experience no large waves of period longer than about 7 seconds, while the other siee must resist waves up to 10 second period; the spans of chambers 22, 22' will accordingly be different thus determining the location of dividing wall 121.

The ballasting arrangement of FIG. 8 may be used, namely comprising tubular bodies 35 fixed in the front walls 20, 20', extending through the chambers to within one meter to 1½ meters of common back wall 121 to form a pair of upwardly-extending passageways 38, 38', and the upper surface of the monoliths cast around the tubes 35 is at a height appropriate to the required ballasting. It should be noted that due to the much broadened dimension of slab bottom 117 including short ledge portions, the uplift effect due to bottom pressure of waves from either side will have a large magnitude, requiring even greater ballasting.

To avoid accretion of sand at a side of the breakwater a tier of small diameter holes 54 may be provided in the lower part of wall 121, to allow migration of entrained sand particles through both front walls, hence correcting a difficulty experienced with known groins.

Figure 14:
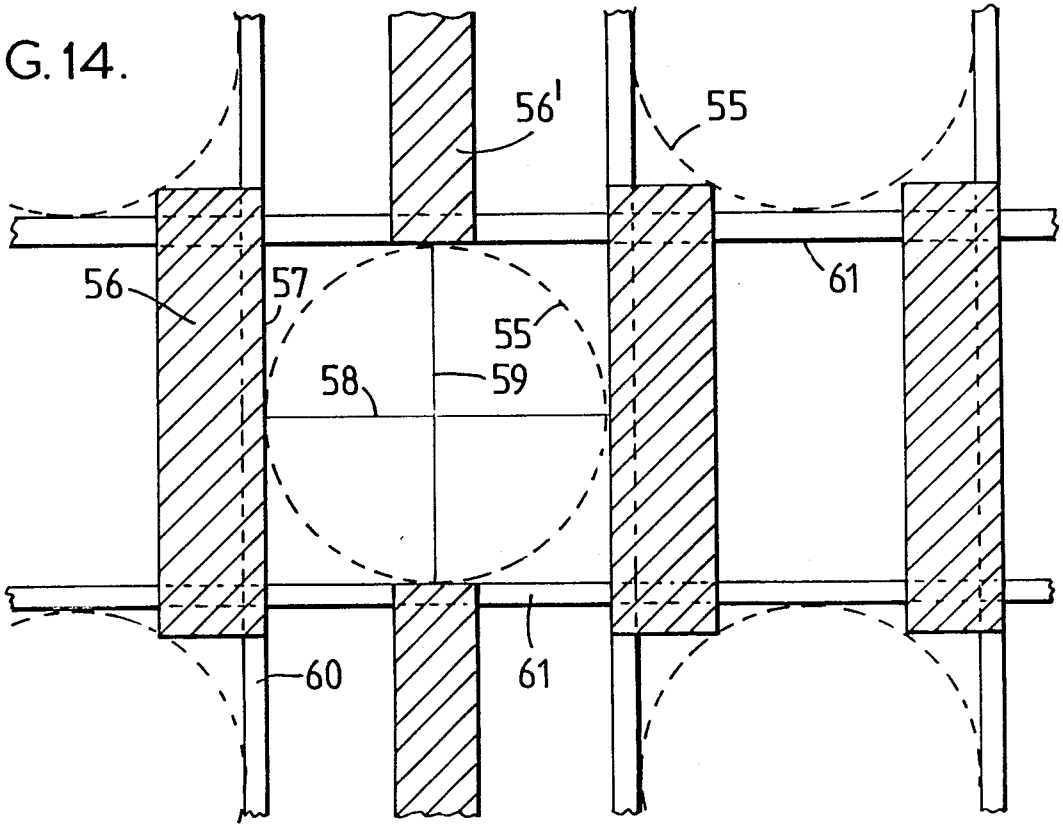
FIG. 14 shows an arrangement of metal slabs and support racks for ballasting a caisson.

In certain installations it may be desirable to increase greatly the weight of the structure with virtually no impediment to horizontal and vertical motions of water in the chamber, thereby assuring virtually no increase of reflection coefficient. Since one cubic meter of steel in seawater exerts downward force about 68,000 Newtons whereas the same volume of concrete produces a gravity force of only about 15,000 Newtons, the use of steel will allow much greater porosity of the ballast mass and a lower height in the chamber. Only lower grades of steel are required since no loads other than their own weight are carried. FIG. 14 shows a section in elevation wherein dashed circles 55 represent cylindric surfaces of phantom tubes coaxial with the axes 26 of front wall passages 25 and of identical diameter, and represent generally the outline of jets flowing from such passages into the chamber. For example, where the passage distribution pattern as shown arranges a first set of passage axis positions at the corners of squares of a grid and arranges axis positions of a second set at the intersections of diagonals of squares of such grid, the disposition of metal ballast is most effectively arranged as tiers of horizontally spaced slabs 56 and 56' as shown. The thickness dimension of such slabs may be from 0.2 to 0.35 m, the slabs extending horizontally, for example coextensive with the chamber span. The width dimension extends vertically, and may be about 1.05 or about 1.25 meters, depending on the tier. As shown, the wider slabs occupy positions with their wide faces 57 tangent with the phantom cylinder 55 at the ends of a horizontal diameter 58, while the other slabs 56' have their narrow faces 59 tangent with the cylinders 55 at the ends of a vertical diameter 59. The set of slabs is supported by vertical framing members 60 and horizontal beams 61, arranged as racks disposed generally adjacent the interior surfaces of walls 20 and 21.

In the practice of the invention, all or part of the concrete or rubble ballast referred to hereinbefore may be replaced wholly or partially with cast, fragmented, scrap or other metal bodies, e.g. low cost steel bodies.

I claim:

1. A breakwater comprising a line of caissons each having an upright front wall extensively perforated by regularly distributed transverse passages, and a second wall spaced from the front wall to form a chamber between the walls, and having a slab bottom, a base of pervious rubble piled on seabed and having a levelled upper surface, said slab bottom resting on said rubble pile and characterised in that, said upper surface is disposed at a depth below mean sea level substantially less than four times the amplitude of the largest predicted wave; in that the weight of the caisson itself is insufficient to anchor the caisson against sliding by friction of said slab bottom relative to said upper surface; in that the caisson carries a ballast mass disposed in said chamber extending upward from the slab bottom to a height below the lowest height of the sea when the trough of said wave is at the front wall, said mass adding sufficient weight to ensure that the ratio of maximum horizontal thrust force of said wave to net downward vertical force including the weight of said mass is below 0.46; and in that said mass is pervious to seawater flowing through said front wall.

2. A breakwater comprising a base of pervious rubble piled on seabed and having a levelled upper surface, a line of unitary concrete caissons each having a pair of upright front walls extensively perforated by regularly-distributed transverse passages and spaced apart, an intermediate wall parallel with said front walls and dividing the space between them into two chambers, a slab bottom integrally joined with said upright walls, and resting upon said upper surface, and characterised in that said upper surface lies at a depth below mean sea level less than four times the amplitude of the largest predicted wave that may impinge either front wall, and wherein the weight of the caisson itself is insufficient to anchor the caisson against sliding by friction of said slab bottom relative to said upper surface, wherein the caisson carries ballast masses disposed in each of said chambers extending upward from the associated portion of the slab bottom to a height below mean sea level which is at least as large as the amplitude of the said wave, said masses adding sufficient weight to ensure that the ratio of maximum horizontal thrust force of said wave to net downward vertical force including the weight of said masses is below 0.46, and said masses are pervious to seawater flowing through an associated front wall.

3. A breakwater as set forth in claim 1 wherein said distributed passages in the front wall are horizontal ducts of diameter between about 0.9 and 1.2 meters and the aggregate cross-sectional area of the passages is about 35% of the elevational area of the wall, and wherein the ballast mass comprises randomly-piled rubble and/or metal fragments providing inter-fragment volume at least about 25% of the bulk volume occupied by the ballast, the size of those fragments emplaced adjacent said front wall being larger than the transverse dimension of said ducts.

4. A breakwater as set forth in claim 1 wherein said ballast mass comprises, in part, cylindric pipes extending horizontally in the lower part of said chamber normally of said front wall and having their one ends fixed in said front wall and opening to the sea, said pipe openings occupying positions in the same distribution pattern as said passage openings, said pipes having their other ends extending through said second wall and opening to the sheltered water outside said second wall.

5. A breakwater as set forth in claim 1 wherein said ballast mass comprises, in part, cylindric pipes extending horizontally in the lower portion of said chamber normally of said front wall and having their one ends fixed in said front wall and opening to the sea, said pipe openings occupying positions in the same distribution pattern as said passage openings, the other ends of said pipes terminating in said chamber and spaced adjacently said second wall to define with the second wall an upwardly extending unobstructed passage, and wherein the remainder of said ballast mass comprises a monolith having an upwardly-extending wall spaced inwardly from said second wall, and said wall presenting openings of said other ends to said passage.

6. A breakwater as set forth in claim 1 wherein said ballast mass comprises, in part, cylindric pipes extending horizontally in the lower portion of said chamber normally of said front wall and having their one ends fixed in said front wall and opening to the sea with said openings in the same distribution pattern as the passages of said front wall, the other ends of said pipes being fixed in said second wall and being closed, said pipes being extensively perforated by ports opening through their cylindric surfaces and allowing interchange of water between the sea and said chamber, and wherein the remainder of said ballast mass comprises a pervious rubble pack emplaced in said chamber surrounding said pipes, said port openings having cross-sectional dimensions fractionally smaller than the least distance between adjacent pipe surfaces and said rubble sizes being in a range allowing free emplacement between said pipes but preventing their ingress into said pipes.

7. A breakwater as set forth in claim 1 wherein said ballast mass comprises, in part, cylindric pipes extending horizontally in the lower portion of said chamber normally of said front wall and having their one ends fixed in said front wall and opening to the sea, said pipe openings occupying positions in the same distribution pattern as said passages of said front wall, said pipes terminating in said chamber with their other ends spaced adjacent said second wall, a wall rising from slab bottom supporting said other ends and defining with said second wall an upwardly open passageway, said pipes being extensively perforated by ports opening through their cylindric surfaces and allowing interchange of water between the chamber and pipe interiors, and wherein the remainder of said ballast mass comprises a pervious rubble pack emplaced in said chamber surrounding said pipes, said ports having cross-sectional dimensions fractionally smaller than the least distance between adjacent pipe surfaces and said rubble sizes being in a range allowing free emplacement between said pipes but preventing their ingress into said pipes.

8. A breakwater as set forth in claim 4 wherein the distance between said front and second walls is correlated with the wavelength of the incident wave of largest predicted amplitude at the site depth, such that for waves of periods about 7 to 10 seconds the span is from 0.10 to 0.125 times the wavelength for waves of periods 10 to 12 seconds the span is from 0.1 to about 0.0833 times the wavelength, and for periods 12 to 15 seconds the span is about 0.833 to about 0.0667 times the wavelength.

9. A breakwater as set forth in claim 2 wherein said intermediate wall includes at least one tier of holes opening near said slab bottom into each chamber, the cross-sectional area of each hole being a small fraction of the area of a passage in said front wals whereby mineral particles entrained in a sea in which said wave is propagating may pass through both said front walls.

10. A breakwater as set forth in claim 2 wherein said line of caissons extends generally at right angles to a shoreline as a groin and said rubble base is of increasing thickness with sea depth.

11. A breakwater as set forth in claim 2, wherein two lines of caissons extend from a shoreline adjacent the mouth of a river flowing into the sea and the lines are sited on opposite sides of a navigable channel along the river bed, and wherein the chamber adjacent that front wall which is exposed to the larger of a pair of predicted largest-amplitude waves likely to be incident from respective sectors facing the said front walls has a span larger than the span of the other chamber.

12. A breakwater as set forth in claim 11 wherein said span dimensions are correlated with the wavelength for the depth of sea at highest mean sea level of the site and the chamber span is from 0.10 to 0.125 times the wavelength for waves of periods about 7 to about 10 seconds, and is from about 0.10 to about 0.0833 times the wavelength of waves of periods from about 10 to about 12 seconds, and is from about 0.0833 to about 0.0667 times the wavelength of waves of periods about 12 to about 15 seconds.

13. A breakwater as set forth in claim 2 wherein said ballast mass comprises, in part, cylindric pipes extending horizontally in the lower portion of each said chamber normally of the front wall and having their one ends integrally fixed in said front wall and opening to the sea with said openings in the same distribution pattern as the passages of said front wall, said pipes terminating in the chamber with their other ends spaced adjacent said intermediate wall, a wall rising from the slab bottom in each chamber supporting said other ends and defining with said intermediate wall an upwardly-open passageway communicating with the interiors of said pipes, and wherein the remainder of said ballast mass comprises ballast material occupying at least a major volume proportion of the space between said pipes.

14. A breakwater as set forth in claim 13 wherein the remainder of said ballast mass comprises concrete solidified around said pipes.

15. A breakwater as set forth in claim 14 wherein the concrete includes a significant proportion of metal fragments admixed as aggregate, and the weight of said mass is preferably sufficient to make said ratio below 0.4.

16. A breakwater as set forth in claim 13 wherein the remainder of said ballast mass comprises rubble and/or metal packed around said pipes.

17. A breakwater as set forth in claim 4 wherein said pipes are thick-walled tubes preformed by spin casting, and their ends are fixed in the respective upright walls by slip-form casting of the walls about said ends.

18. A breakwater as set forth in claim 16 wherein said pipes are extensively perforated by ports opening through their cylindric surfaces, said ports having cross-sectional dimensions fractionally smaller than the least distance between adjacent pipe surfaces and said rubble sizes being in a range allowing free emplacement between said pipes but preventing their ingress into said pipes.

19. A breakwater as set forth in claim 1 wherein said front wall has a substantially planar exterior surface and said transverse passages comprise cylindric holes having axes normal to said planar surface, and said front wall carries augmenting ballast bodies having one planar side allowing flush mounting of said bodies against said exterior surface, means fixing each of said bodies to said front wall, said bodies comprising a centrally-apertured square of side dimension such that said bodies may be mounted in the same distribution pattern as said passages, wherein the aperture diameter in the plane of said exterior surface is identical with the passage diameter and the aperture surface is a body of revolution about said axis characterised by gradual smooth increase of diameter in the axial direction outwardly from said from wall to about 140% of the passage diameter within a distance about one-half of the passage diameter.

20. A breakwater as set forth in claim 19 wherein said body is formed by casting concrete.

21. A breakwater as set forth in claim 19 wherein said body includes a shell shaped to provide said aperture surface and formed of corrosion-resistant metal and the remainder of the body is concrete.

22. A breakwater as set forth in claim 1 wherein said passages are distributed over said front wall area as a first set of passages having axes disposed at the corners of squares of a first grid of horizontally and vertically spaced passages,and as a second set of passages having axes disposed at the intersections of diagonals of squares of said first grid and forming a second grid, and wherein the ballast mass comprises tiers of horizontally-spaced metal slabs of thickness about 0.2 to 0.35 meter, said slabs being oriented with their width dimension vertical and having horizontal length substantially coextensive with the chamber span, the slabs of one set of tiers being positioned with their wide faces approximately tangent at opposite ends of a horizontal diameter of a phantom cylindric surface coaxial with each passage of one grid set of passages and of the same diameter as said passages, and the slabs of a second set of tiers having their narrow faces tangent with said surfaces at opposite ends of a vertical diameter, said ballast mass including support frameworks extending upwardly from said slab bottom, the slabs not obstructing flow from any passage.

23. A breakwater as set forth in claim 22 wherein said support frameworks comprise at least two grids each formed of vertical and horizontal members, said members being roughly tangent with said phantom cylindric surface at the ends of a horizontal and a vertical diameter, respectively, wherein the vertical members stand upon said slab bottom and include one group closely adjacent the wall opposite to the front wall.

24. A breakwater as set forth in claim 1 wherein said upper surface of said base is at a depth between about 2.6 and 3.4 times said amplitude.

25. A breakwater as set forth in claim 1 wherein said upper surface is at least about 0.6 meters above seabed.

26. A breakwater as set forth in claim 1 wherein said slab bottom and said front and back walls are connected integrally with upright transverse bracing walls spaced along the horizontal length of the caisson, said bracing walls having about 45% of their elevational areas comprised of openings, and wherein said ballast mass occupies said openings to the vertical extent of said mass.

27. A breakwater as set forth in claim 1 wherein said slab bottom and said front and back walls are connected integrally with upright transverse apertured bracing walls spaced along the horizontal extent of the caisson, and said slab bottom includes horizontal ledges extending respectively beyond the front and back walls and resting on said rubble base, and said bracing walls include integral outward extensions joined with said ledges and with the exterior surfaces of said front and back walls, said extensions rising less than about 10 meters above said rubble base, and wherein rubble fragments of sizes larger than the cross-sectional dimensions of said passages are piled upon said ledges and said rubble base.

* * * * *

UNITED STATES PATENT AND TRADEMARK OFFICE

CERTIFICATE OF CORRECTION

PATENT NO. : 4,764,052

DATED : August 16, 1988

INVENTOR(S) : Gerard E. Jarlan

It is certified that error appears in the above-identified patent and that said Letters Patent is hereby corrected as shown below:

Abstract: Line 6, "trust" should read --thrust--.

Column 1: Line 14, "may" should read --many--.

Line 62, "dampling" should read --damping--.

Column 5: Line 50, "horizontaly" should read --horizontally--.

Column 6: Line 13, "wetter" should read --wetted--.

Line 43, "$\lambda_d 10$" should read --$\lambda d/10$--.

Line 53, $g^{T2}2\pi$" should read --$gT^2/2\pi$--.

Column 7, Line 28, the denominator in Equation (2)

" $\sinh \frac{2\ d}{d}$ " should read -- $\sinh \frac{2\pi d}{\lambda_d}$ --.

Signed and Sealed this

Twenty-second Day of August, 1989

*Attest:*

*Attesting Officer*

DONALD J. QUIGG

*Commissioner of Patents and Trademarks*